US008958714B2

(12) United States Patent
Matsuno

(10) Patent No.: US 8,958,714 B2
(45) Date of Patent: Feb. 17, 2015

(54) ELECTRONIC DEVICE AND IMAGE FORMING APPARATUS

(71) Applicant: KYOCERA Document Solutions Inc., Osaki-shi, Osaka (JP)

(72) Inventor: Akinori Matsuno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 120 days.

(21) Appl. No.: 13/722,224

(22) Filed: Dec. 20, 2012

(65) Prior Publication Data

US 2013/0164020 A1 Jun. 27, 2013

(30) Foreign Application Priority Data

Dec. 22, 2011 (JP) ..... 2011-282011

(51) Int. Cl.
*G03G 15/00* (2006.01)
*H05F 3/02* (2006.01)
*G03G 21/16* (2006.01)

(52) U.S. Cl.
CPC ..... *G03G 15/80* (2013.01); *H05F 3/02* (2013.01); *G03G 21/1652* (2013.01); *G03G 21/1619* (2013.01)
USPC ..... 399/90

(58) Field of Classification Search
CPC ..... G03G 21/1652; G03G 15/80; G03G 21/1867; G03G 21/1871
USPC ..... 399/90
See application file for complete search history.

(56) References Cited

U.S. PATENT DOCUMENTS 5,926,666 A 7/1999 Miura et al.
7,062,192 B2 * 6/2006 Oguma et al. ..... 399/90

FOREIGN PATENT DOCUMENTS

JP 10-123918 A 5/1998
JP 2008-46535 A 2/2008

* cited by examiner

*Primary Examiner* — Walter L Lindsay, Jr.
*Assistant Examiner* — Frederick Wenderoth
(74) *Attorney, Agent, or Firm* — Arent Fox LLP

(57) ABSTRACT

An electronic device and image forming apparatus include a main body and an attachment unit. The main body includes a main-body side connector. The attachment unit includes a unit-side connector connectable with the main-body side connector and is mounted detachably on the main body. The main body includes a static electricity prevention member and a biasing member. The static electricity prevention member is configured to be movable between a first position and a second position. The static electricity prevention member partially or completely covers an outer periphery of a terminal of the main-body side connector at the first position and exposes this terminal at the second position. The attachment unit presses the static electricity prevention member from the first position to the second position against a biasing force applied by the biasing member, such that the main-body side connector is connected with the unit-side connector.

12 Claims, 13 Drawing Sheets

ELECTRONIC DEVICE AND IMAGE FORMING APPARATUS

INCORPORATION BY REFERENCE

This application is based upon and claims the benefit of priority from the corresponding Japanese Patent Application No. 2011-282011, filed in the Japan Patent Office on Dec. 22, 2011, the entire contents of which are incorporated herein by reference.

BACKGROUND

This disclosure relates to an electronic device, and in particular relates to an electronic device including a unit that is detachably mounted on a main body, such as an image forming apparatus.

A conventional electrographic image forming apparatus such as a printer, copying machine, facsimile, multifunctional device, or the like adopts a setup in which a unit such as an image forming unit or the like is mounted detachably on a main body. When an electrical connection is required between the main body and the unit, a setup is known in which a main-body side connector provided on the main body is connected with a unit side connector provided on the unit.

An image forming apparatus having such a setup may be associated with a risk that a substrate of the main-body side connector undergoes electrostatic breakdown caused by flow of static electricity from the body of an operator such as a user or service personnel (hereinafter simply referred to as "an operator") into the substrate of the main-body side connector through a terminal of the main-body side connector, when a hand of the operator comes into contact with the terminal of the main-body side connector during retraction of the unit to troubleshoot a jam. A setup is known in which a static electricity prevention member is disposed in a periphery of a terminal of a main-side connector to thereby prevent contact of a hand of an operator with a terminal on the main-body side connector.

It is preferred that the static electricity prevention member is disposed as close as possible with respect to the terminal at the main-body side connector, such that the static electricity prevention member securely prevents the hand of an operator from coming into contact with the terminal of the main-body side connector. However, a space is required in a periphery of the terminal of the main-body side connector for engaging the main-body side connector with the unit-side connector. Accordingly, it is required that the static electricity prevention member be disposed so as not to interfere with this space. As a result, it has been difficult to dispose the static electricity prevention member sufficiently close to the terminal of the main-body side connector.

SUMMARY

In an aspect of the present disclosure, an electronic device includes a main body and an attachment unit. The main body includes a main-body side connector. The attachment unit includes a unit-side connector configured to be connectable with the main-body side connector and is mounted detachably on the main body. The main body includes a static electricity prevention member and a biasing member. The static electricity prevention member is configured to be movable between a first position and a second position. The static electricity prevention member partially or completely covers an outer periphery of a terminal of the main-body side connector at the first position and exposes the terminal of the main-body side connector at the second position. The biasing member is configured to bias the static electricity prevention member toward the first position. When the attachment unit is mounted on the main body, the attachment unit presses the static electricity prevention member from the first position to the second position against a biasing force applied by the biasing member, such that the main-body side connector is connected with the unit-side connector.

DETAILED DESCRIPTION

Figure 1:
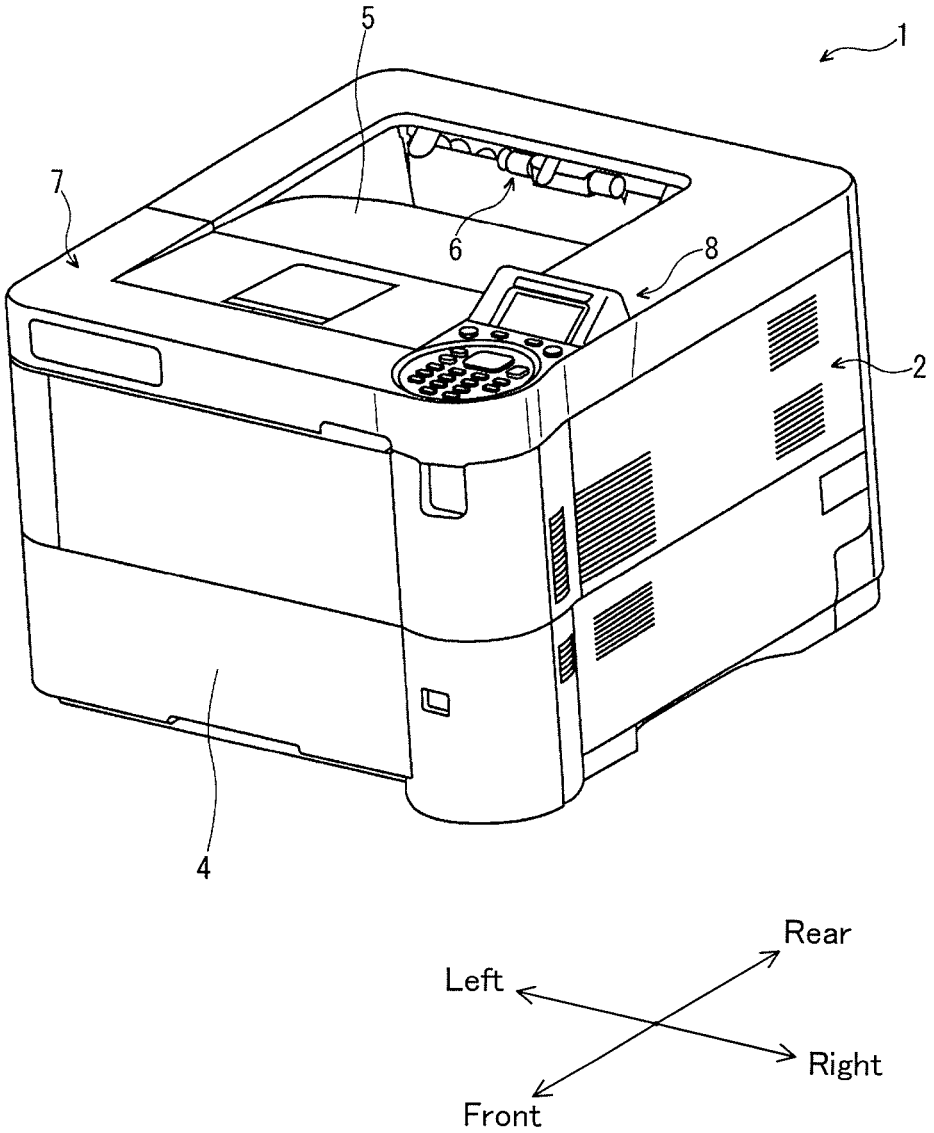
FIG. 1 is a perspective view of a printer according to an embodiment of the present disclosure.

A printer 1 will be described as an example of an image forming device according to an embodiment of the present disclosure making reference to the figures. For the sake of convenience of the description, a left and forward side of the face of a page in FIG. 1 is taken to be a front side of the printer 1.

Figure 2:
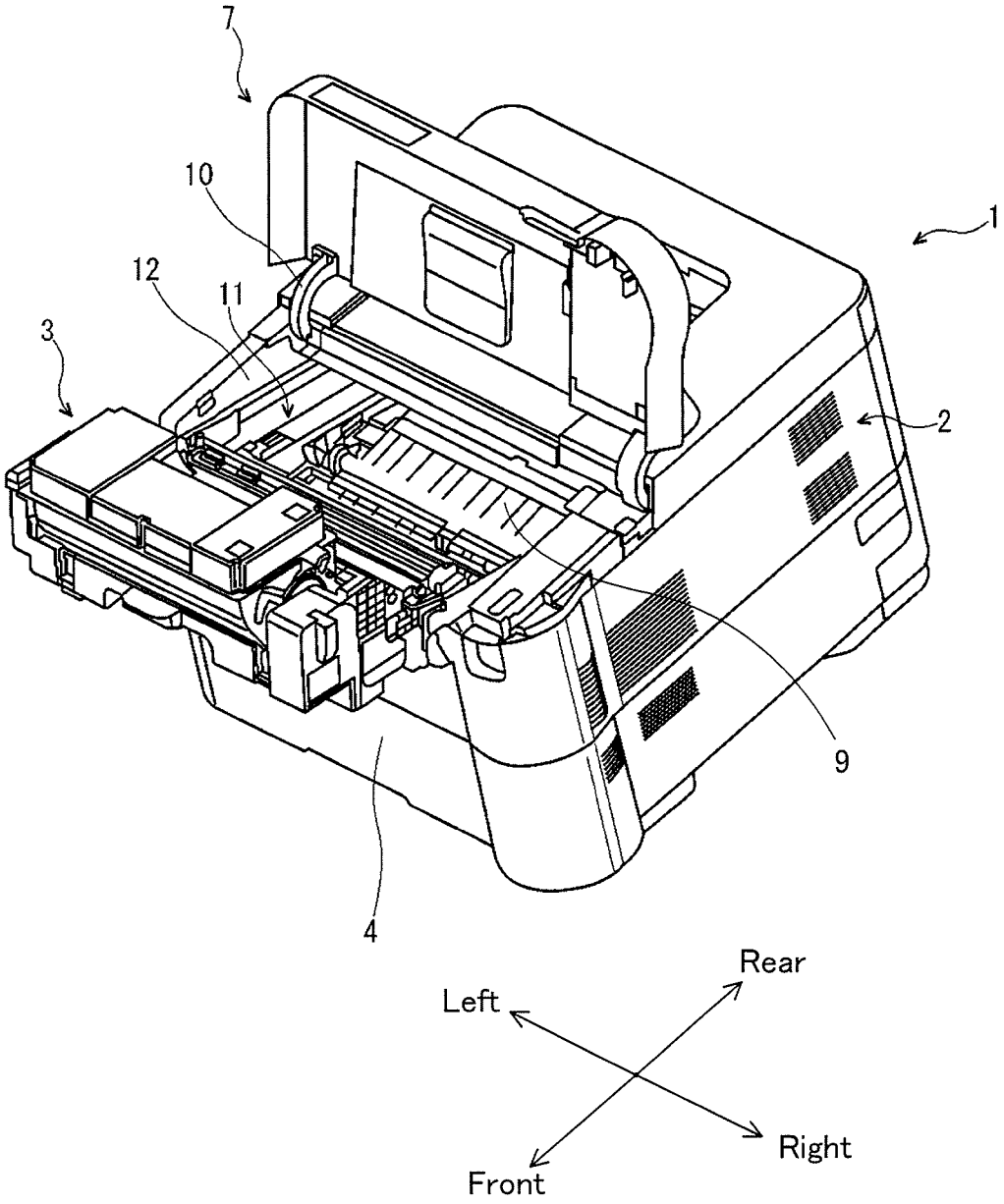
FIG. 2 is a perspective view of an image forming unit being retracted in a front direction in the printer according to the embodiment of the present disclosure.

Firstly, a setup of the printer 1 will be described making reference to FIG. 1 to FIG. 8. As illustrated in FIG. 1 and FIG. 2, the printer 1 includes a box-shaped main body 2 and an image forming unit 3 mounted on the main body 2 (refer to FIG. 2).

The main body 2 will be described. As illustrated in FIG. 1, the main body 2 is of a substantially rectangular solid shape. A paper feed tray 4 drawable in a front direction is provided at a lower portion of the main body 2. A paper discharge tray 5 is provided at a central portion on an upper side of the main body 2. A paper discharge unit 6 is provided at a rear portion on the upper side of the main body 2. A conveyance path 9 for conveying a sheet of paper from the paper feed tray 4 to the paper discharge unit 6 is provided inside the main body 2.

An upper cover 7 is provided at a front portion on an upper side of the paper discharge tray 5. An operation panel 8, which performs setting of various functions of the printer 1, is provided at a front corner of the upper cover 7. As illustrated in FIG. 2, the upper cover 7 is configured to be openable and closable about a hinge unit 10 provided at a rear end portion of the upper cover 7. A unit accommodating space 11 is formed below the upper cover 7 and opposes the conveyance path 9 inside the main body 2.

Figure 3:
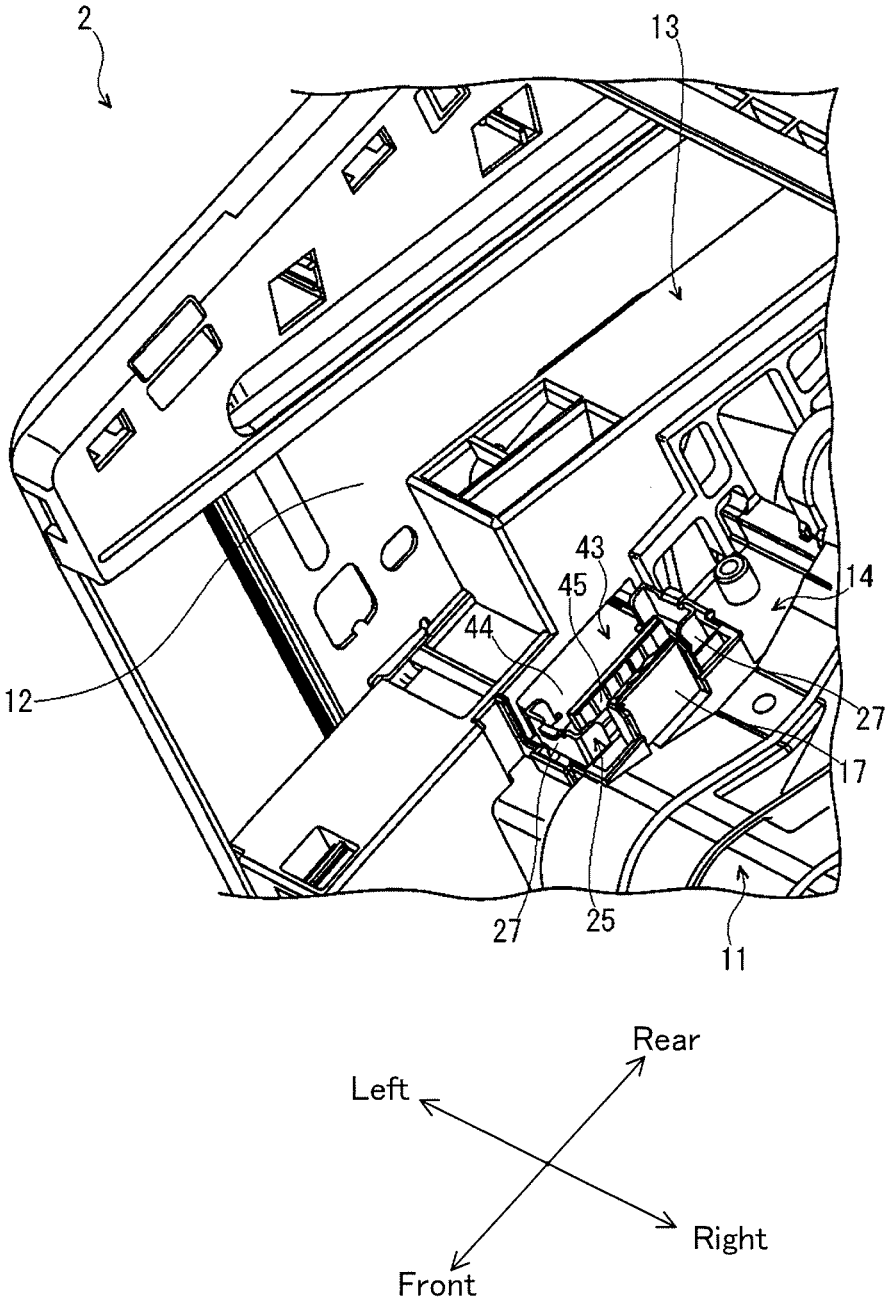
FIG. 3 is a perspective view illustrating an inner side of a left frame in a main body of the printer according to the embodiment of the present disclosure.

As illustrated in FIG. 3, a left frame 12 is vertically provided at a left end portion of the main body 2. The left frame 12 is formed from sheet metal for example, and exhibits an electrically conductive characteristic. The left frame 12 is connected to an electrical ground of the main body 2.

One guide rail 13 that inclines downwardly in a rear direction is provided at a left portion of the unit accommodating space 11 and on an inner side of an upper portion of the left frame 12. Another guide rail 13 (not illustrated) is provided on an inner side of a right frame provided at a right end portion of the main body 2.

Figure 4:
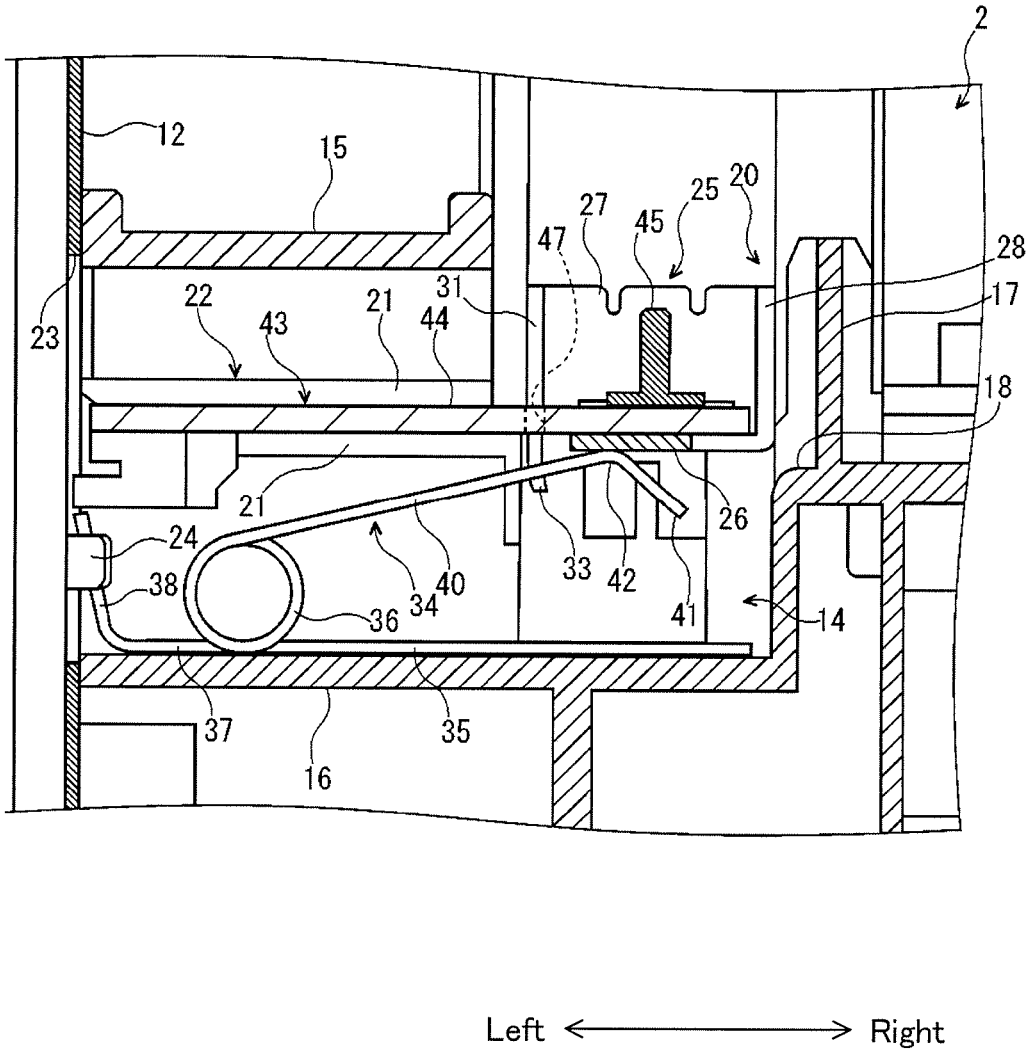
FIG. 4 is a sectional view illustrating a periphery of a main-body side connector in the main body of the printer according to the embodiment of the present disclosure.

An apparatus mounting portion 14 is provided below the guide rail 13 and outside the conveyance path 9 on an inner side with respect to a front portion of the left frame 12. As illustrated in FIG. 4, an upper side of the apparatus mounting portion 14 is covered by an upper partitioning plate 15 extending in a horizontal direction, and a lower side thereof is covered by a lower partitioning plate 16 extending in a horizontal direction. The lower partitioning plate 16 extends further to the right than a right end portion of the upper partitioning plate 15. A right partitioning plate 17 projects upwardly from a right end portion of the lower partitioning plate 16. A step 18 is formed midway at the right partitioning plate 17 in a vertical direction. A connecting opening 20 is formed between a right end portion of the upper partitioning plate 15 and an upper end portion of the right partitioning plate 17.

An insertion rail 22 composed of a vertical pair of elongated protrusions 21 is provided vertically midway at a front side and a rear side of the apparatus mounting portion 14 in a left-right direction. The apparatus mounting portion 14 communicates with a space positioned to the left with respect to the left frame 12 through an insertion opening 23 provided at the left frame 12. A hook 24 is attached to the left frame 12, such that the hook 24 projects through the insertion opening 23 in a right direction.

A static electricity prevention member 25 is installed to be vertically movable at a right portion of the apparatus mounting portion 14. The static electricity prevention member 25 is formed from sheet metal for example, and exhibits an electrically conductive characteristic. The static electricity prevention member 25 includes a bottom plate 26 extending in a horizontal direction, front and rear first covering plates 27 which bend respectively at front and rear ends of the bottom plate 26 and extend upwardly, and a second covering plate 28 which bends at a right end of the bottom plate 26 and extends upwardly.

Figure 5:
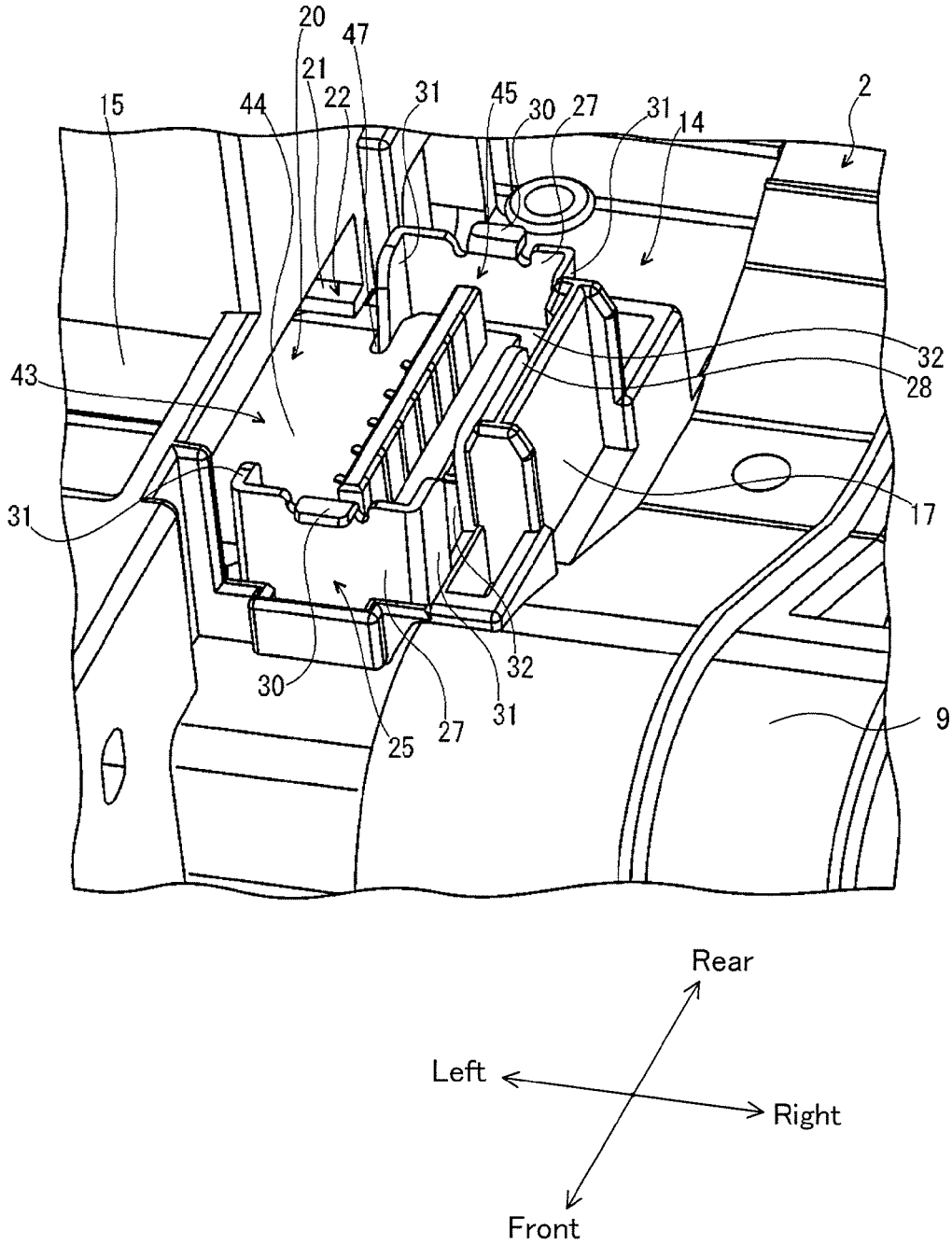
FIG. 5 is a perspective view illustrating a periphery of the main-body side connector in the main body of the printer according to the embodiment of the present disclosure.

As illustrated in FIG. 5, tabs 30 are provided, which bend outwardly at upper ends of the front and rear first covering plates 27 (bending forward for the front first covering plate 27 and bending backward for the rear first covering plate 27). Guide portions 31 are provided at left and right ends of each of the first covering plates 27, respectively. The guide portions 31 bend inwardly (bending backward for the front first covering plate 27 and bending forward for the rear first covering plate 27). Each of the front and rear first covering plates 27 including the guide portions 31 is of a substantially letter U shape when viewed in plan view. A cutout 32 is formed between the second covering plate 28 and the guide portion 31 on the right side of each of the first covering plates 27. An extension 33 is provided on the guide portion 31 on the left side of each of the first covering plates 27 to extend below the bottom plate 26 (refer to FIG. 4).

As illustrated in FIG. 4, a biasing member 34 is detachably mounted on a lower portion of the apparatus mounting portion 14. The biasing member 34 is formed from a wire spring for example, and exhibits an electrically conductive characteristic. The biasing member 34 includes a first lower portion 35 extending in a left-right direction, a coil portion 36 connected to a left end of the first lower portion 35, a second lower portion 37 extending to the left from the coil portion 36, a fixing portion 38 curving upwardly to the left from a left end of the second lower portion 37, an upper portion 40 extending upwardly to the right from the coil portion 36, and an abutting portion 41 curving downward to the right in proximity to a right end of the upper unit 40.

The fixing portion 38 engages with the hook 24 of the left frame 12, such that the biasing member 34 is secured inside the apparatus mounting portion 14. A boundary portion (bent portion) of the abutting portion 41 and the upper unit 40 of the biasing member 34 functions as a pressing portion 42. The pressing portion 42 comes into contact with the bottom plate 26 of the static electricity prevention member 25 to thereby press the bottom plate 26 upwardly. As a result, the static electricity prevention member 25 is biased upwardly. As clearly illustrated from the above description, the electrically conductive biasing member 34 is in mechanical contact with both the static electricity prevention member 25 and the left frame 12, each of which exhibits an electrically conductive characteristic. That is to say, the static electricity prevention member 25 establishes electrical continuity with the left frame 12 through the biasing member 34.

Figure 6:
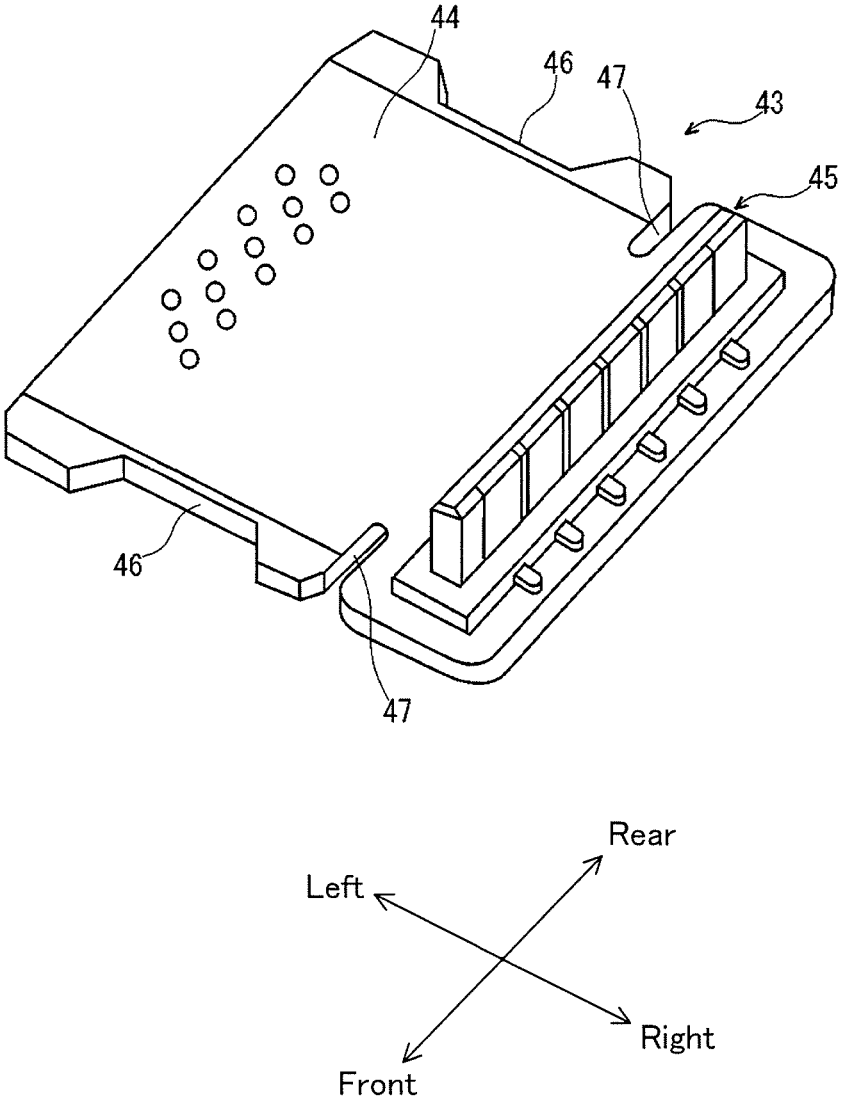
FIG. 6 is a perspective view illustrating the main-body side connector in the main body of the printer according to the embodiment of the present disclosure.

A main-body side connector 43 is detachably attached to a substantially vertically central portion of the apparatus mounting portion 14. As illustrated in FIG. 6, the main-body side connector 43 includes a substrate 44 horizontally provided and a terminal 45 that projects upwardly from a right portion of an upper surface of the base plate 44.

The substrate 44 is electrically connected with a power supply unit (not illustrated) provided at the main body 2. The substrate 44 has a substantially rectangular shape when viewed in plan view. Both front and rear end portions of the substrate 44 are engaged with the insertion rail 22 of the apparatus mounting portion 14 (refer to FIG. 4). As illustrated in FIG. 6, a groove 46 is provided at each of the front and rear end portions of the substrate 44, starting from a left-side portion to a central portion in a left-right direction. Engagement portions 47 each substantially in a shape of a letter U when viewed in plan view are provided at both front and rear end portions of the substrate 44 and to the right with respect to the groove 46. Each of the engagement units 47 engages with a guide portion 31 on a left side of each of the first covering plates 27 of the static electricity prevention member 25.

The terminal 45 is electrically connected with the substrate 44. As illustrated in FIG. 5, the terminal 45 projects upwardly from an upper surface of the substrate 44 and faces the connecting opening 20 of the apparatus mounting portion 14. Both front and rear sides of the terminal 45 are covered by the first covering plates 27 of the static electricity prevention member 25, respectively, and the right side is covered by the second covering plate 28 of the static electricity prevention member 25. That is to say, the outer periphery of the terminal 45 is partially covered by the static electricity prevention member 25.

Next, the image forming unit 3 will be described. The image forming unit 3 is housed in the unit accommodating space 11 of the main body 2. A toner image formed by the image forming unit 3 is transferred and fixed to a sheet of paper supplied from the paper feed tray 4 and conveyed along a conveyance path (not illustrated). Thereafter, the sheet of paper is discharged to the paper discharge tray 5 through the paper discharge unit 6.

Figure 7:
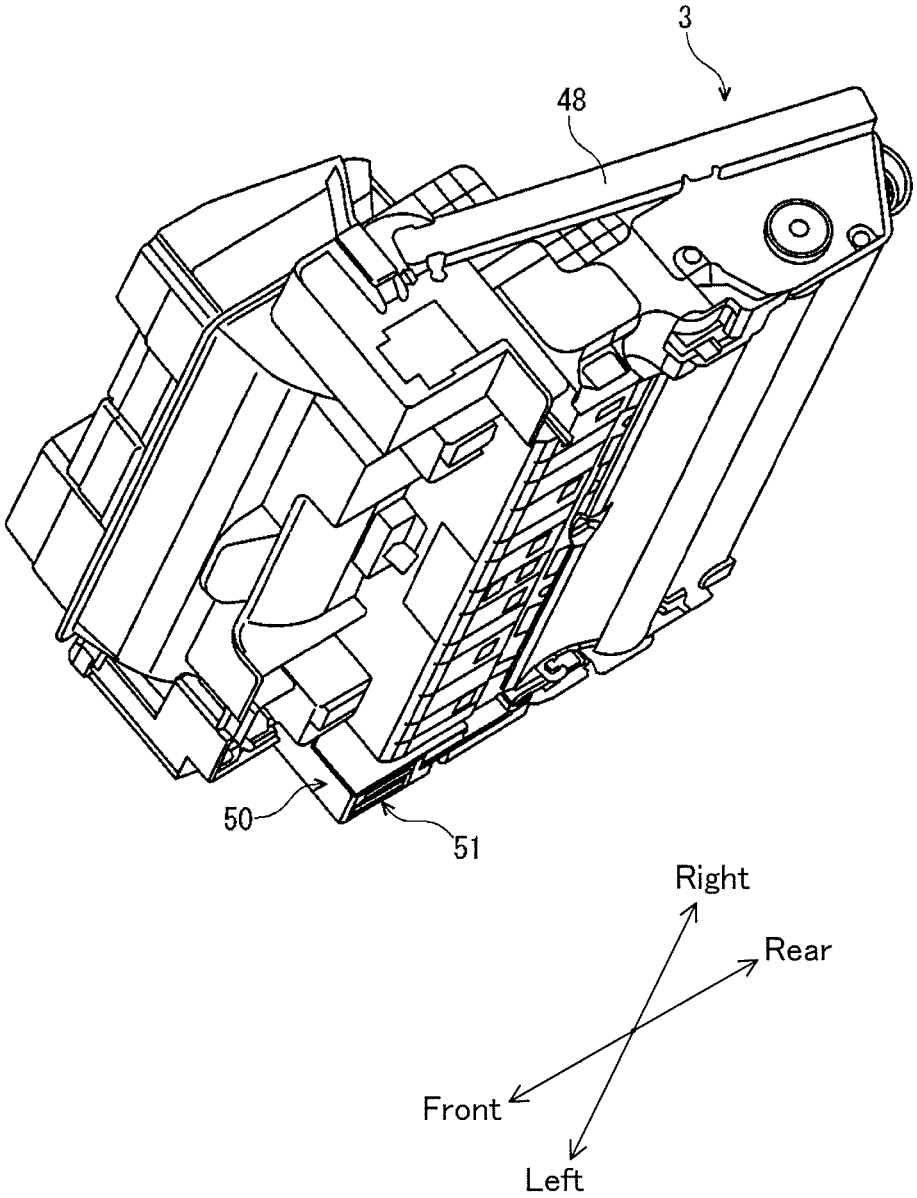
FIG. 7 is a perspective view illustrating an image forming unit in the printer according to the embodiment of the present disclosure.

As illustrated in FIG. 7, a protrusion 48, which has a downward slope in a rear direction, is provided on each of right and left side surfaces of the image forming unit 3. For example, when a jam is troubleshot, it is possible to attach and detach the image forming unit 3 from the main body 2 if the image forming unit 3 is slid relative to the main body 2 while the protrusion 48 is engaged with the guide rail 13 of the main body 2.

A connector mounting portion 50 is provided at a front end and a left lower end of the image forming unit 3. The connector mounting portion 50 is formed for example from sheet metal and exhibits an electrically conductive characteristic. The connector mounting portion 50 establishes electrical continuity with electrically conductive components inside the image forming unit 3.

Figure 8:
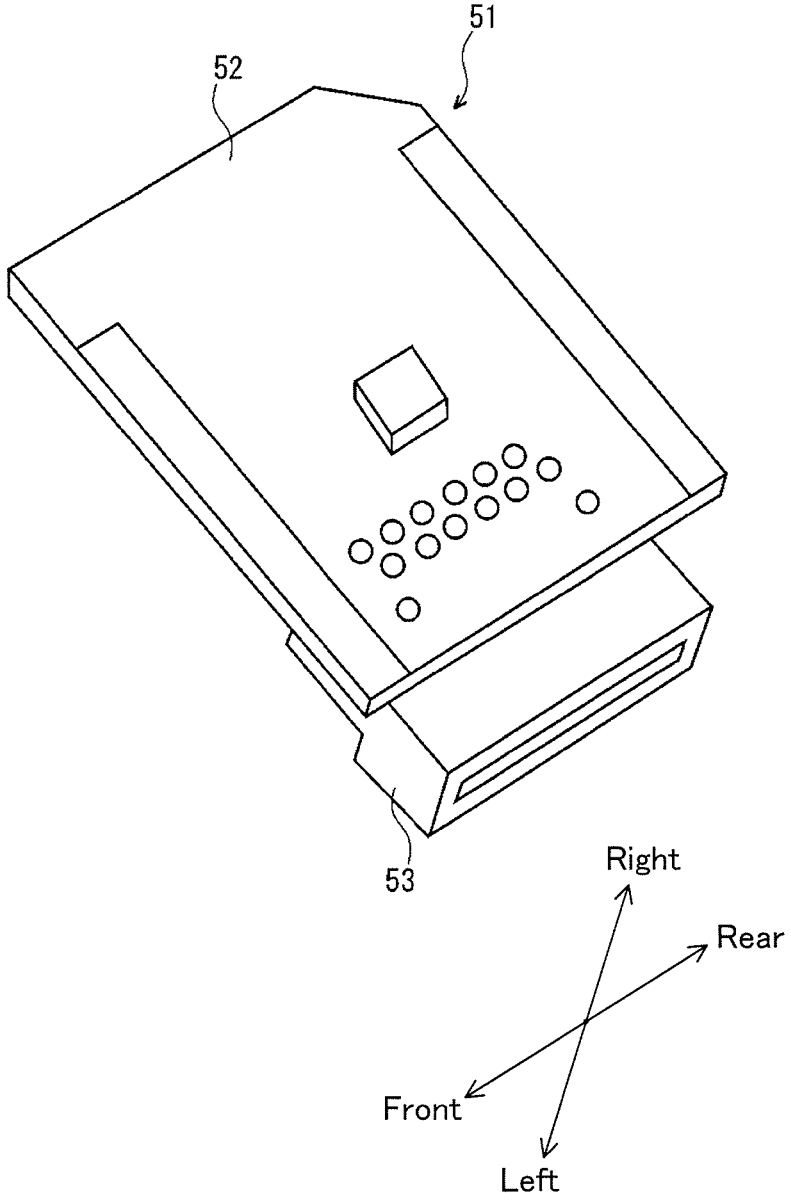
FIG. 8 is a perspective view illustrating a unit-side connector in the image forming unit of the printer according to the embodiment of the present disclosure.

A unit-side connector 51 is installed in the connector mounting portion 50. As illustrated in FIG. 8, the unit-side connector 51 includes a substrate 52 vertically oriented and a terminal accommodating portion 53 fixed to a lower end of a left surface of the substrate 52.

The substrate 52 is of a substantially rectangular shape when viewed in side view. The substrate 52 is electrically connected to the electrical components inside the image forming unit 3 (for example, a motor for rotating various types of rollers). The terminal accommodating portion 53 is configured as a square prism. A terminal (not illustrated) electrically connected with the substrate 52 is contained in the terminal connection portion 53.

Figure 9:
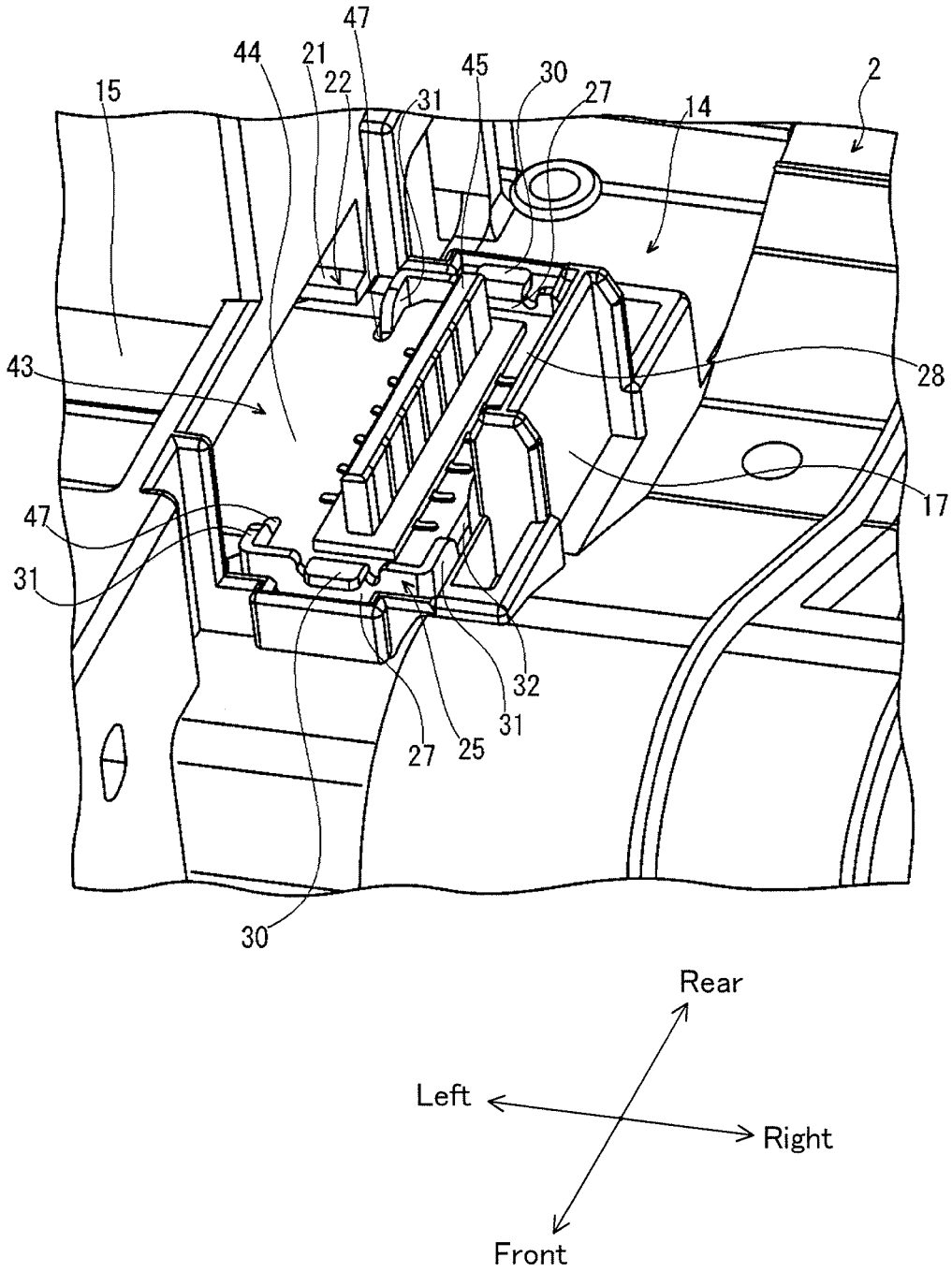
FIG. 9 is a perspective view illustrating a static electricity prevention member having moved to a second position in the main body of the printer according to the embodiment of the present disclosure.
Figure 10:
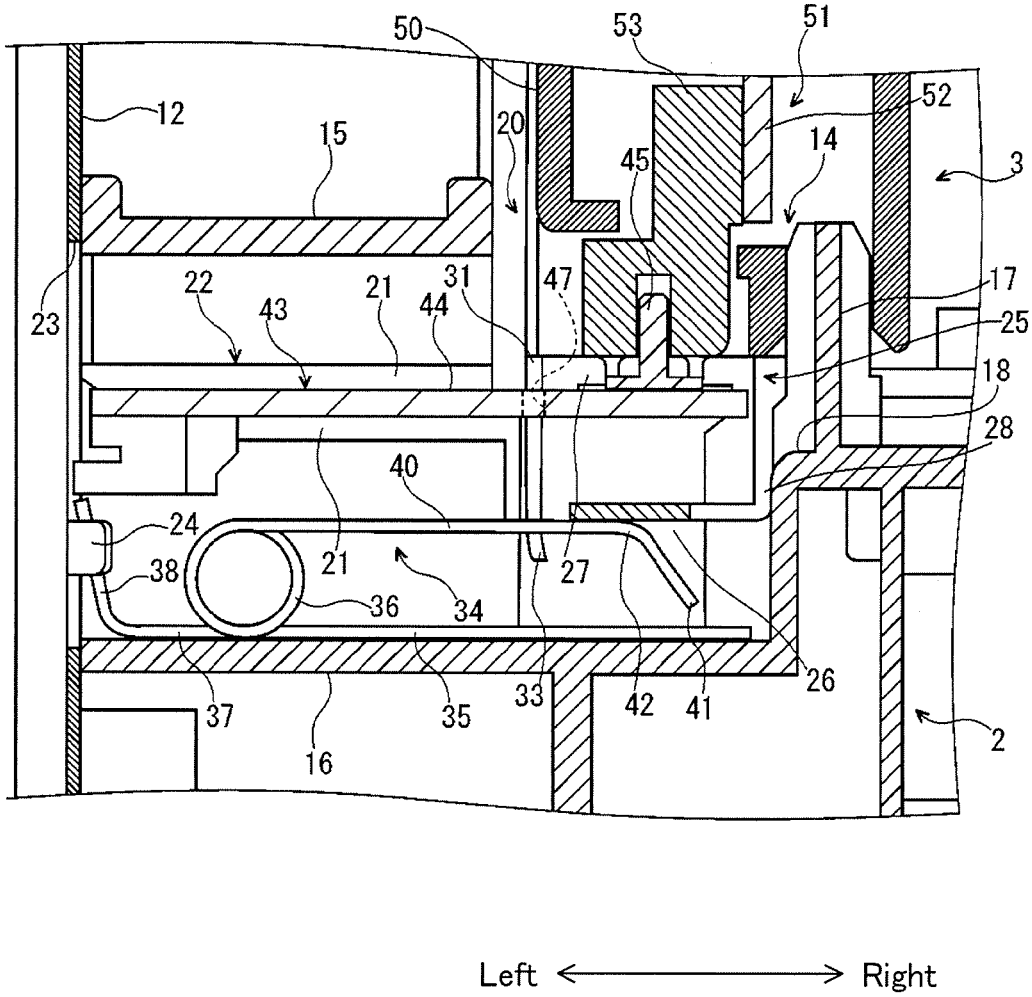
FIG. 10 is a sectional view illustrating the main-body side connector connected with the unit-side connector in the printer according to the embodiment of the present disclosure.

The operation of the static electricity prevention member 25 will be described mainly with reference to FIG. 9 and FIG. 10, when the image forming unit 3 is mounted onto the main body 2 in relation to the setup described above. FIG. 9 is a perspective view illustrating the static electricity prevention member having moved to the second position in the main body of the printer according to the embodiment of the present disclosure. FIG. 10 is a sectional view illustrating the main-body side connector connected with the unit-side connector in the printer according to the embodiment of the present disclosure.

When the image forming unit 3 is removed from the main body 2, the static electricity prevention member 25 is biased upwardly by a biasing force applied by the biasing member 34 (refer to FIG. 4). Accordingly, an outer periphery of the terminal 45 of the main-body side connector 43 is partially covered by the respective first covering plates 27 and the second covering plate 28 of the static electricity prevention member 25. As a result, it is possible to prevent a hand of an operator from coming into contact with the terminal 45 of the main-body side connector 43 (refer to FIG. 5). A position of the static electricity prevention member 25 at this time is termed a "first position".

Starting from this configuration, when the image forming unit 3 is mounted onto the main body 2, a lower end of the connector mounting portion 50 of the image forming unit 3 presses the static electricity prevention member 25 downwardly against the biasing force applied by the biasing member 34. As illustrated in FIG. 9, the pressed static electricity prevention member 25 descends. Accordingly, the terminal 45 of the main-body side connector 43 is exposed. A position of the static electricity prevention member 25 at this time is termed a "second position".

Mounting of the image forming unit 3 onto the main body 2 causes the terminal accommodating portion 53 of the unit-side connector 51 to engage with the terminal 45 of the main-body side connector 43 as illustrated in FIG. 10. A terminal (not shown) accommodated in the terminal accommodating portion 53 of the unit-side connector 51 is connected with the terminal 45 of the main-body side connector 43. In this manner, the main body 2 is electrically connected with the image forming unit 3. Accordingly, it is possible that the power supply unit in the main body 2 supplies electric power to the electrical components inside the image forming unit 3. In this connection, when the image forming unit 3 is mounted on the main body 2, the lower end of the connector mounting portion 50 of the image forming unit 3 is in contact with the static electricity prevention member 25.

As described above in the present embodiment, mounting of the image forming unit 3 onto the main body 2 causes the static electricity prevention member 25 to move to a position at which the terminal 45 of the main-body side connector 43 is exposed. Accordingly, even when the static electricity prevention member 25 is disposed sufficiently close to the terminal 45 of the main-body side connector 43, the static electricity prevention member 25 will not impede the engagement of the terminal 45 of the main-body side connector 43 with the terminal accommodating portion 53 of the unit-side connector 51. Since it is possible to place the static electricity prevention member 25 sufficiently close to the terminal 45 of the main-body side connector 43, it is possible to securely prevent a hand of an operator from coming into contact with the terminal 45. In this manner, it is possible to prevent electrostatic breakdown of the substrate 44 resulting from flow of static electricity from the body of the operator into the substrate 44 through the terminal 45 of the main-body connector 43.

In addition, the static electricity prevention member 25 establishes electrical continuity through the biasing member 34 with the left frame 12 that is connected with the electrical ground of the main body 2. As a result, when a hand of an operator comes into contact with the static electricity prevention member 25, it is possible to divert the static electricity from the body of the operator into the left frame 12 through the static electricity prevention member 25 and the biasing member 34. It is not necessary to add a new component for establishing electrical continuity between the static electricity prevention member 25 and the left frame 12, since electrical continuity is established between them via the biasing member 34. As a result, it is possible to suppress an increase in the number of components and reduce costs.

Furthermore, the connector mounting portion 50, which establishes electrical continuity with the internal electrically conductive components, is provided in the image forming unit 3. The connector mounting portion 50 is in contact with the static electricity prevention member 25 when the image forming unit 3 is mounted on the main body 2. As a result, it is possible to divert the static electricity charged in the electrically conductive components of the image forming unit 3 through the connector mounting portion 50, the static electricity prevention member 25 and the biasing member 34 to the left frame 12 that is connected with the electrical ground. That is to say, it is possible to provide an electrical grounding for the image forming unit 3 using the left frame 12. The left frame 12 will be efficiently utilized, accordingly.

Figure 11:
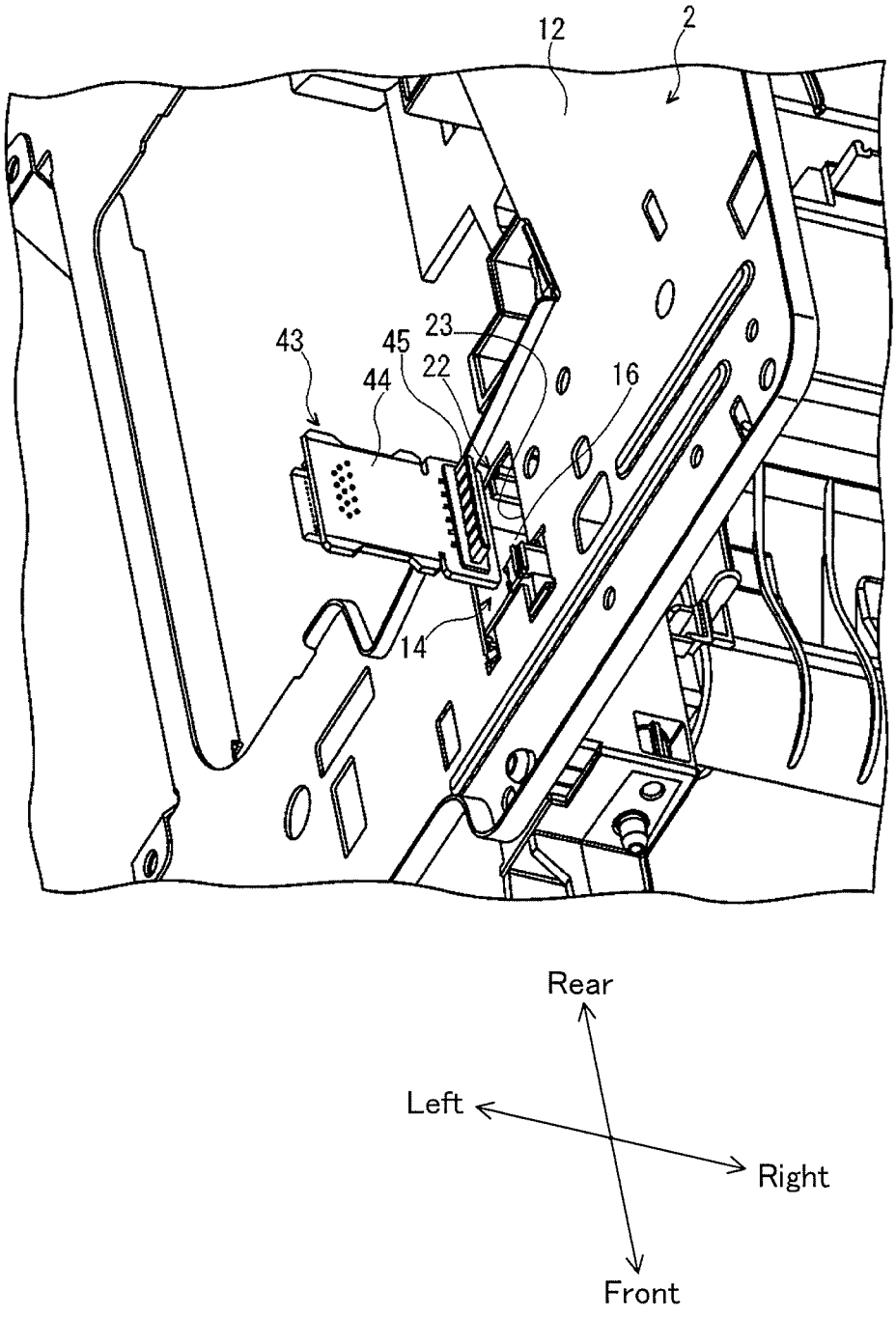
FIG. 11 is a perspective view illustrating the main-body side connector retained at a left side of a left frame in the printer according to the embodiment of the present disclosure.
Figure 12A:
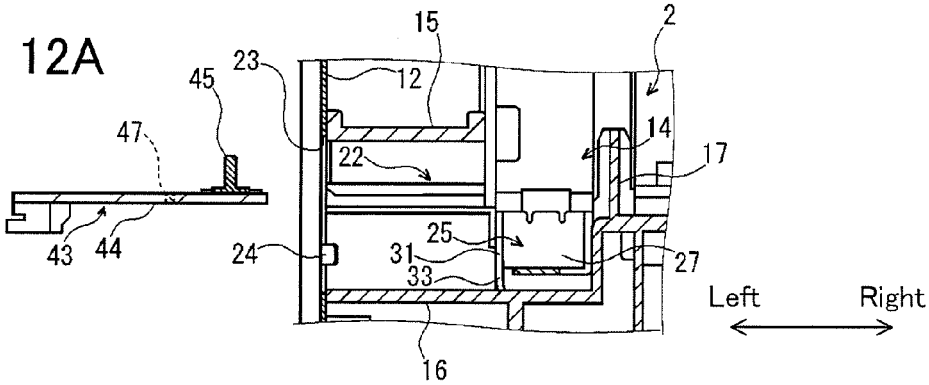
FIG. 12A is a sectional view illustrating the main-body side connector retained at the left side of the left frame.
Figure 12B:
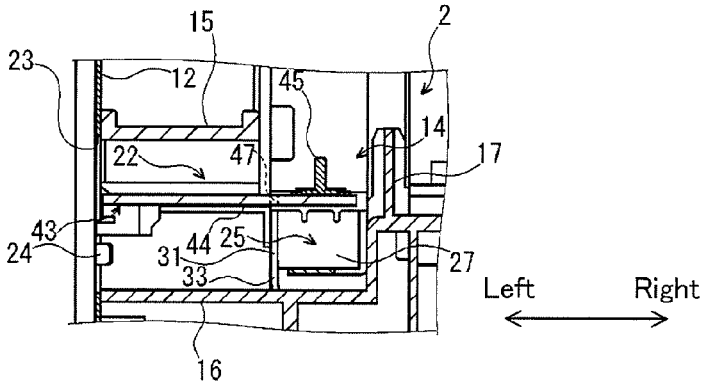
FIG. 12B is a sectional view of the main-body side connector inserted into an apparatus mounting portion.
Figure 12C:
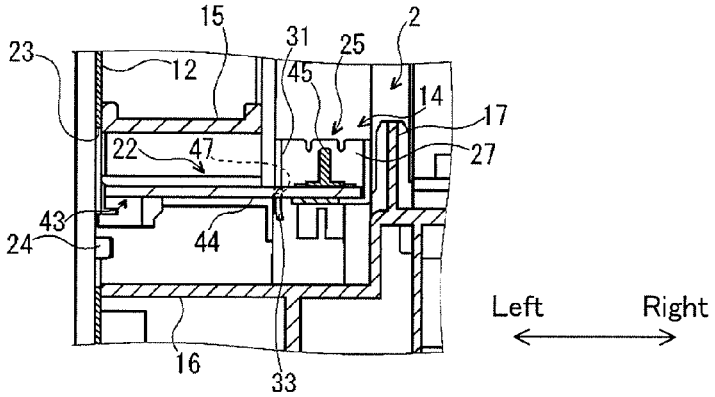
FIG. 12C is a sectional view of the static electricity prevention member raised from a configuration illustrated in FIG. 12B in the printer according to the embodiment of the present disclosure.

Next, a method of attaching and detaching the main-body side connector 43 from the main body 2 will be described in relation to the setup described above mainly making reference to FIG. 11 and FIG. 12. FIG. 11 is a perspective view illustrating the main-body side connector retained on the left of the left frame in the printer according to the embodiment of the present disclosure. FIG. 12A is a sectional view illustrating the main-body side connector retained on the left of the left frame. FIG. 12B is a sectional view illustrating the main-body side connector inserted into an apparatus mounting portion. FIG. 12C is a sectional view illustrating the static electricity prevention member raised from the configuration illustrated in FIG. 12B in the printer according to the embodiment of the present disclosure.

The mounting operation of the main-body side connector 43 onto the main body 2 is such that firstly the static electricity prevention member 25 is set at a position lower than the second position as illustrated in FIG. 12A, and then a lower end of the extension 33 of the static electricity prevention member 25 is brought into abutment with an upper surface of the lower partitioning plate 16. A position of the static electricity prevention member 25 at this time is termed a "third position".

As illustrated in FIG. 11 and FIG. 12A, the main-body side connector 43 is retained in a horizontal orientation on an outer side (left side) of the left frame 12. As illustrated in FIG. 12B, while both front and rear end portions of the base plate 44 of the main-body side connector 43 are engaged with the insertion rail 22 of the apparatus mounting portion 14, the main-body side connector 43 is inserted into the apparatus mounting portion 14 of the main body 2 through the insertion opening 23 of the left frame 12.

Then, as illustrated in FIG. 12C, while the engagement portion 47 of the main-body side connector 43 is engaged with the guide portion 31 of the left side of the static electricity prevention member 25, the static electricity prevention member 25 is raised to the first position. In this configuration, as illustrated in FIG. 4, the biasing member 34 is mounted on the main body 2. That is to say, the biasing member 34 is inserted below the static electricity prevention member 25, and the pressing portion 42 of the biasing member 34 is brought into contact with the bottom plate 26 of the static electricity prevention member 25. The fixing portion 38 of the biasing member 34 is brought into engagement with the hook 24 of the left frame 12. In this manner, the mounting operation for the main-body side connector 43 onto the main body 2 is completed.

Figure 13:
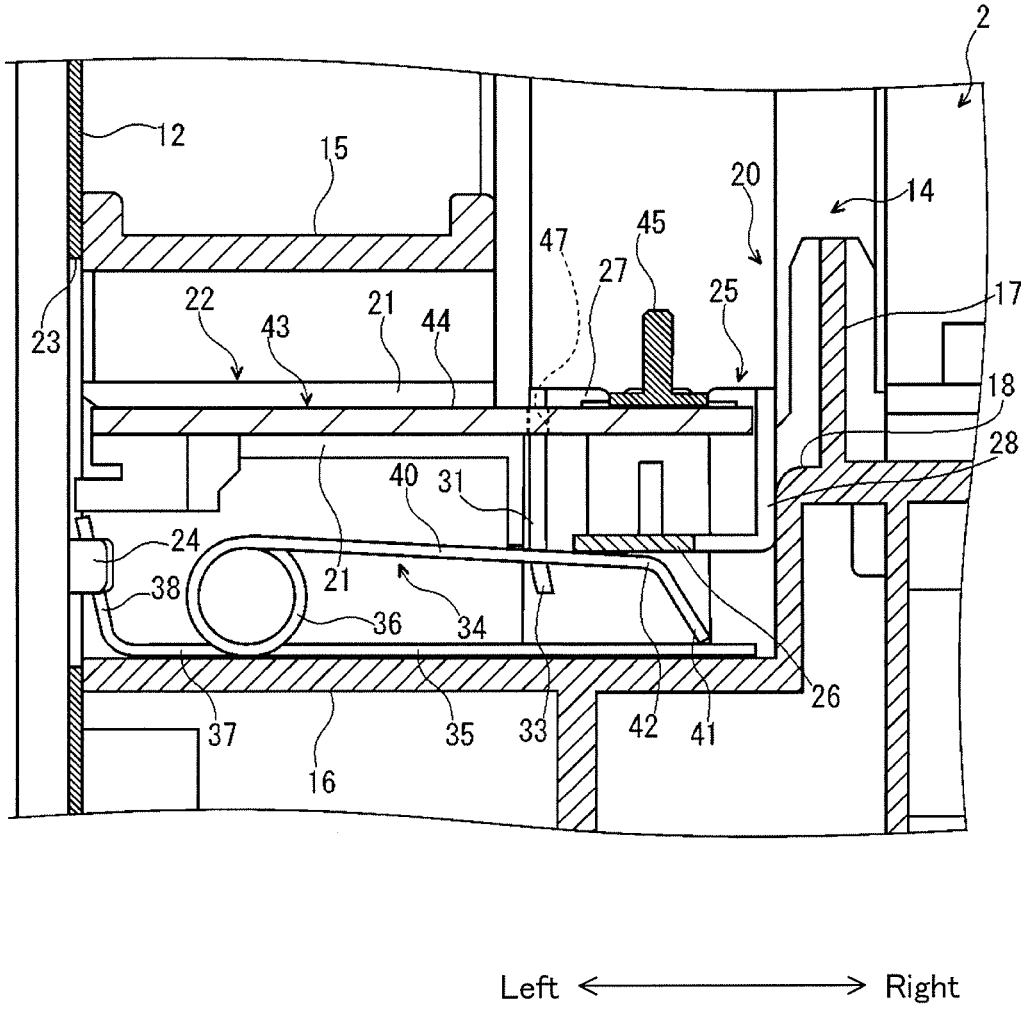
FIG. 13 is a sectional view illustrating a configuration in which the main-body side connector and a biasing member are mounted on the main body, and the static electricity prevention member is maximally depressed in the printer according to the embodiment of the present disclosure.

The configuration is illustrated in FIG. 13, in which the main-body side connector 43 and the biasing member 34 are mounted on the main body 2, and the static electricity prevention member 25 is maximally depressed. In this configuration, the abutting portion 41 of the biasing member 34 abuts with an upper surface of the lower partitioning plate 16, and restricts the static electricity prevention member 25 from being further depressed. Consequently, it is not possible to depress the static electricity prevention member 25 to the third position. As a result, the guide portions 31 on the left side of the static electricity prevention member 25 are prevented from disengaging from the engaging portions 47 of the main-body side connector 43. Therefore, the removal of the main-body side connector 43 from the main body 2 is suppressed.

In this connection, it may be that the removal of the main-body side connector 43 from the main body 2 is performed in the following steps: Remove the biasing member 34 from the main body 2. Subsequently, depress the static electricity prevention member 25 to the third position and pull the main-body side connector 43 to a left side of the left frame 12.

Since the main-body side connector 43 is detachably attached to the main body 2 in the embodiment described above, it is possible to facilitate exchange of the main-body side connector 43 when the main-body side connector 43 is defective, for example. Since the biasing member 34 restricts the guide portions 31 on the left side of the static electricity prevention member 25 from disengaging from the engaging portions 47 of the main-body side connector 43, it is unnecessary to add a new member to retain the engagement between them described above. As a result, it is possible to suppress an increase in number of components and reduce costs.

In the present embodiment, the outer periphery of the terminal 45 of the main-body side connector 43 has been described to be partially covered by the static electricity prevention member 25. However, it may be alternatively possible in a different embodiment that the outer periphery of the terminal 45 of the main-body side connector 43 is completely covered by the static electricity prevention member 25.

In the present embodiment, the biasing member 34 has been described to be formed from a wire spring. However, it may be alternatively possible in a different embodiment that the biasing member 34 is formed by a plate spring or the like.

In the present embodiment, the connector mounting portion 50 of the image forming unit 3 has been described to be formed from sheet metal. It may be alternatively possible in a different embodiment that the connector mounting portion 50 of the image forming unit 3 is formed from plastic.

In the present embodiment, the printer 1 has been described to which the setup according to the present disclosure is applied. However, it may be alternatively possible in a different embodiment that it is applied to another image forming apparatus such as a copying machine, a facsimile machine, a multifunctional device, or the like.

The invention claimed is:

1. An electronic device comprising:

a main body including a main-body side connector; and an attachment unit including a unit-side connector configured to be connectable with the main-body side connector, the attachment unit being mounted detachably on the main body, wherein the main body comprises:

a static electricity prevention member configured to be movable between a first position and a second position in a connecting direction in which the main-body side connector connects with the unit-side connector, where a covering plate of the static electricity prevention member which projects up to a location higher than an end of the main-body side connector is configured to partially or completely cover an outer periphery of a terminal of the main-body side connector at the first position and to retract to a location at which the terminal of the main-body side connector is exposed at the second position; and a biasing member configured to bias the static electricity prevention member toward the first position; and wherein when the attachment unit is mounted on the main body, the attachment unit presses the static electricity prevention member from the first position to the second position against a biasing force applied by the biasing member, such that the main-body side connector is connected with the unit-side connector.

2. The electronic device according to claim 1, wherein the main body includes a frame connected to an electrical ground of the main body, and wherein the static electricity prevention member establishes electrical continuity with the frame through the biasing member.

3. The electronic device according to claim 2, wherein the attachment unit comprises a connector mounting portion configured to mount the unit-side connector, the connector mounting portion establishing electrical continuity with electrically conductive components inside the attachment unit and being in contact with the static electricity prevention member when the attachment unit is mounted on the main body.

4. The electronic device according to claim 2, wherein the main-body side connector includes an engagement portion configured to be engageable with the static electricity prevention member and be detachably mounted on the main body, wherein the biasing member is configured to be detachably mounted on the main body, and wherein when the biasing member is mounted on the main body while the static electricity prevention member is engaged with the engagement portion, the biasing member prevents the static electricity prevention member from disengaging from the engagement portion, such that the main-body side connector is prevented from being removed from the main body.

5. The electronic device according to claim 3, wherein the main-body side connector includes an engagement portion configured to be engageable with the static electricity prevention member and be detachably mounted on the main body, wherein the biasing member is configured to be detachably mounted on the main body, and wherein when the biasing member is mounted on the main body while the static electricity prevention member is engaged with the engagement portion, the biasing member prevents the static electricity prevention member from disengaging from the engagement portion, such that the main-body side connector is prevented from being removed from the main body.

6. An image forming apparatus comprising:

a main body including a conveyance path for conveying a sheet and a main-body side connector; and an image forming unit for forming an image on the sheet, the image forming unit including a unit-side connector configured to be connectable with the main-body side connector and being mounted detachably on the main body, wherein the main body comprises:

a static electricity prevention member configured to be movable between a first position and a second position in a connecting direction in which the main-body side connector connects with the unit-side connector, where a covering plate of the static electricity prevention member which projects up to a location higher than an end of the main-body side connector is configured to partially or completely cover an outer periphery of a terminal of the main-body side connector at the first position and to retract to a location at which the terminal of the main-body side connector is exposed at the second position; and a biasing member configured to bias the static electricity prevention member toward the first position; and wherein when the image forming unit is mounted on the main body, the image forming unit presses the static electricity prevention member from the first position to the second position against a biasing force applied by the biasing member, such that the main-body side connector is connected with the unit-side connector.

7. The image forming apparatus according to claim 6, wherein the main-body side connector is provided outside the conveyance path, and the image forming unit is mounted detachably to the main body such that the image forming unit faces the conveyance path.

8. The electronic device according to claim 1, wherein the main body comprises an apparatus mounting portion at which a connecting opening is formed, and wherein the static electricity prevention member is installed at the connecting opening and is movable in a predetermined direction.

9. The electronic device according to claim 8, wherein the main-body side connector is attachably and detachably installed at the apparatus mounting portion, and wherein the main-body side connector comprises a substrate, from a surface of which the terminal of the main-body side connector projects.

10. The electronic device according to claim 9, wherein the apparatus mounting portion comprises an insertion rail, wherein both ends opposite to each other of the substrate are configured to engage with the insertion rail such that the substrate is supported movably in attaching and detaching directions thereof and restrained from moving in directions other than the attaching and detaching directions.

11. The electronic device according to claim 10, wherein the main-body side connector includes an engagement portion configured to be engageable with the static electricity prevention member, wherein the biasing member is configured to be detachably mounted on the main body, and wherein when the biasing member is mounted on the main body while the static electricity prevention member is engaged with the engagement portion, the biasing member prevents the static electricity prevention member from disengaging from the engagement portion, such that the main-body side connector is prevented from being removed from the main body.

12. The electronic device according to claim 11, wherein the covering plate of the static electricity prevention member is configured to be shaped substantially like a letter "U" when viewed in a moving direction of the static electricity prevention member and to partially cover the outer periphery of the terminal of the main-body side connector, and wherein the covering plate is configured to engage with the engagement portion such the main-body side connector is restricted from being removed from the main body.

* * * * *